US008985435B2

(12) United States Patent
Canter et al.

(10) Patent No.: US 8,985,435 B2
(45) Date of Patent: Mar. 24, 2015

(54) LANDING LIGHTS FOR MULTI-PURPOSE CONFIGURABLE VOTING SYSTEM

(71) Applicant: Hart Intercivic, Inc., Austin, TX (US)

(72) Inventors: James M. Canter, Austin, TX (US); Philip J. Nathan, Royal Oak, MI (US); Edward Patrick Perez, Austin, TX (US); Denton L. Simpson, Round Rock, TX (US); Drew Eldridge Tinney, Austin, TX (US)

(73) Assignee: Hart Intercivic, Inc., Austin, TX (US)

( * ) Notice: Subject to any disclaimer, the term of this patent is extended or adjusted under 35 U.S.C. 154(b) by 0 days.

(21) Appl. No.: 13/967,083

(22) Filed: Aug. 14, 2013

(65) Prior Publication Data

US 2014/0048600 A1 Feb. 20, 2014

Related U.S. Application Data

(60) Provisional application No. 61/683,175, filed on Aug. 14, 2012.

(51) Int. Cl.
*G07C 13/00* (2006.01)
*G07C 13/02* (2006.01)

(52) U.S. Cl.
CPC ..... *G07C 13/02* (2013.01); *G07C 13/00* (2013.01)
USPC ..... 235/51; 235/386

(58) Field of Classification Search
USPC ..... 235/51, 386, 375
See application file for complete search history.

(56) References Cited

U.S. PATENT DOCUMENTS

| | | | | |
|---|---|---|---|---|
| 6,951,303 | B2 * | 10/2005 | Petersen et al. | 235/386 |
| 7,344,071 | B2 * | 3/2008 | Cummings et al. | 235/386 |
| 2010/0198200 | A1 * | 8/2010 | Horvath | 606/10 |

* cited by examiner

*Primary Examiner* — Christle I Marshall

(57) ABSTRACT

A ballot processing device flashes one or more lights of the ballot processing device in a first color when the ballot processing device is ready to receive a ballot. The ballot processing device lights a portion of the one or more lights of the ballot processing device in a second color when the ballot processing device is not ready to receive a ballot.

20 Claims, 3 Drawing Sheets

LANDING LIGHTS FOR MULTI-PURPOSE CONFIGURABLE VOTING SYSTEM

The present application incorporates by reference the content of U.S. Provisional Patent Application No. 61/683,175, filed Aug. 14, 2012 entitled "MULTI-PURPOSE CONFIGURABLE VOTING SYSTEMS" and the content of U.S. Non-Provisional patent application Ser. No. 13/967,054 filed Aug. 14, 2013 and entitled "MULTI-PURPOSE CONFIGURABLE VOTING SYSTEMS."

TECHNICAL FIELD

The present application relates generally to voting machines and, more specifically, to electronic voting machines.

BACKGROUND

Voting machines are used to interpret ballots; to cast and count votes; to report or display election results; and to maintain and produce any audit trail information. Electronic voting machines use modern electronic technology to improve the speed, efficiency, and accessibility of voting. Scan units on electronic voting machines allow for automated processing of paper ballots.

Scan units of electronic voting machines do not provide meaningful or sufficient feedback to voters or poll workers that the scan unit is ready to receive a ballot. It would therefore be desirable to provide enhanced visual indicators recognizable by voters and placed where a voter's attention is directed, in the paper chute where ballots are placed and inserted. Scan units of electronic voting machines also do not provide feedback to voters regarding the processing of the ballot at the location of the voter's attention—the paper chute, rather than a display screen.

SUMMARY

A method of a ballot processing device is provided. The method comprises flashing one or more lights of the ballot processing device in a first color, shape or strobe pattern when the ballot processing device is ready to receive a ballot. The method further comprises lighting a portion of the one or more lights of the ballot processing device in a second color, shape or strobe pattern when the ballot processing device is not ready to receive a ballot.

An electronic voting machine is provided. The electronic voting machine comprising a ballot processing device, and one or more lights housed by the ballot processing device. The one or more lights of the ballot processing device are configured to be flashed in a first color when the ballot processing device is ready to receive a ballot. A portion of the one or more lights of the ballot processing device are configured to be lit in a second color when the ballot processing device is not ready to receive a ballot.

A computer readable medium is provided. The computer readable medium comprises a program containing instructions that, when executed by one or more processors, cause the one or more processors to flash one or more lights of the ballot processing device in a first color when the ballot processing device is ready to receive a ballot. The instructions further cause the one or more processors to light a portion of the one or more lights of the ballot processing device in a second color when the ballot processing device is not ready to receive a ballot.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 4, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged electronic device.

Figure 1:
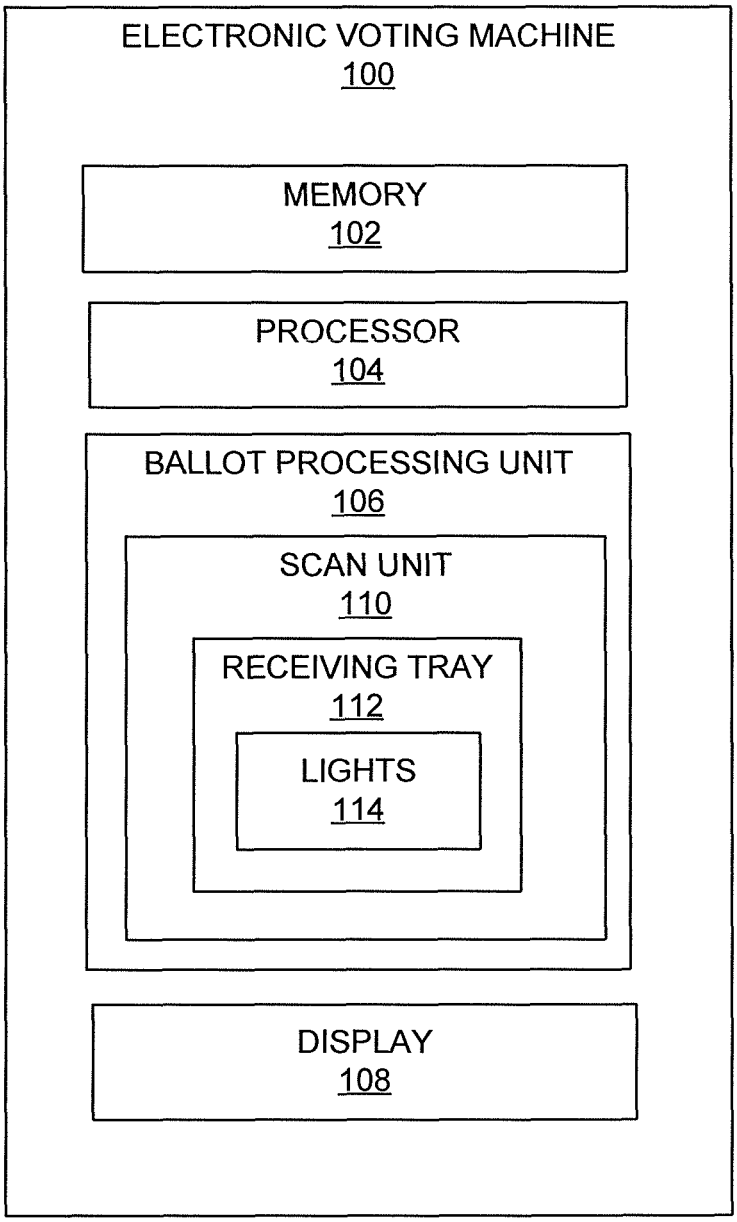
FIG. 1 is a high level block diagram for an embodiment of an electronic voting machine in accordance with certain embodiments of the present disclosure.

FIG. 1 illustrates an embodiment of electronic voting machine 100 in accordance with certain embodiments of the present disclosure. The embodiment shown in FIG. 1 is for illustration only. Other embodiments could be used without departing from the scope of this disclosure.

Electronic voting machine 100 comprises one or more memories 102, one or more processors 104, that processing unit 106, and display 108. Electronic voting machine 100 is a portable modular system that is used to aid the process of casting votes in an election. Electronic voting machines 100 is small, easy to set up, easy to transport, and easy to reconfigure. Electronic voting machine 100 is compliant with one or more versions of the Voluntary Voting System Guidelines (VVSG) as prepared by the United States Election Assistance Commission.

One or more memories 102 store instructions and data related to operation of electronic voting machines 100. One more memories 102 comprise a nonvolatile memory used to store voting information. One or more memories 102 stores instructions that when executed by one or more processors 104 cause the one or more processors 104 to perform the operations of electronic voting machine 100.

One or more processors 104 execute instructions stored in one or more memories 102 to perform the operations of electronic voting machines 100. Electronic voting machine 100 can comprise several devices connected together, each of which can comprise one or more processors of one or more processors 104.

Ballot processing unit 106 processes a ballot that is used to vote. Ballot processing unit 106 can count each ballot that is processed by ballot processing unit 106. Ballot processing unit 106 comprises scan unit 110.

Scan unit 110 is used to scan a ballot and check the ballot for errors, such as too many or too few selections were made for issues or contests being voted on. Scan unit 110 comprises receiving tray 112.

Receiving trade 112 receives a ballot that is to be processed by ballot processing unit 106. Receiving tray 112 comprises one or more lights 114.

One or more lights 114 are used to aid the voting process. One or more lights 114 flash sequentially in a direction towards an input of scan unit 110 to indicate that electronic voting machine 100 is ready to receive a ballot and to indicate where the ballot should be placed in one for electronic voting machine 100 to receive ballot. A portion of one or more lights 114 light up in a different color without flashing to indicate that electronic voting machine 100 is not ready receive a ballot.

Display 108 displays information relating to electronic voting machine 100 to a voter voting with electronic voting machine 100 or a poll worker using electronic voting machine 100. When a ballot contains an error, a message is displayed to indicate the error and to request whether the ballot should be cast with the error.

Figure 2:
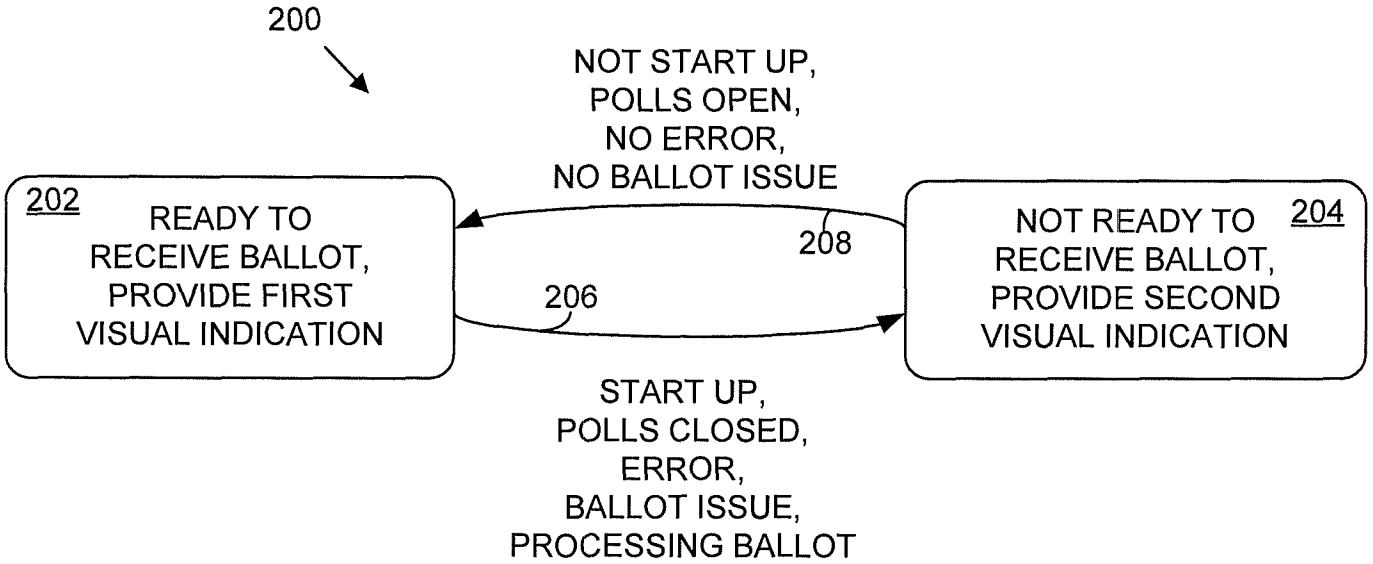
FIG. 2 illustrates a state diagram for the operation of an electronic voting machine in accordance with certain embodiments of the present disclosure.

FIG. 2 illustrates a state diagram 200 for operation of electronic voting machine 100 in accordance with certain embodiments of the present disclosure. The embodiment shown in FIG. 2 is for illustration only. Other embodiments with different states and transitions could be used without departing from the scope of this disclosure.

State diagram 200 can identify a state of electronic voting machines 100. State diagram 200 includes states 202 and 204 and transitions 206 and 208.

In-state 202, and electronic voting machine is ready to receive a ballot and provides a first visual indications to indicate the readiness to receive a ballot. The first visual indication comprises flashing one or more lights of a ballot processing unit of an electronic voting machine.

In-state 204, an electronic voting machine is not ready to receive a ballot and provides a second visual indication to indicate the non-readiness to receive a ballot the second visual indication comprises steady lighting without flashing one or more lights of a ballot processing unit of an electronic voting machine.

Transition 206 takes state diagram 200 from ready state 202 to not-ready state 204. Transition 206 occurs, is based on, and is responsive to one or more of when electronic voting machine is starting up, polls are closed, there is an error, and when there is an issue with a ballot. When electronic voting machine initially starts up, it is not ready to receive ballots for voting. Polls may open and close several times during an election, during which time electronic voting machine should not process ballots. Any error with an electronic voting machine can render it unsuitable to process ballots, such errors include a paper jam in a scan unit of the electronic voting machine and the detection of an attempt to gain unauthorized access to the electronic voting machine. A ballot can comprise too many or too few selections for a single issue and when this is detected electronic voting machine may delay receiving the ballot and verify that such a ballot is intended to be cast by a voter.

Transition 208 takes state diagram 200 from not ready state 204 to ready state 202. Transition 208 occurs, is based on, and is responsive to one or more of when electronic voting machine is not starting up, polls are open, there are no errors, and there are no ballot issues.

Figure 3:
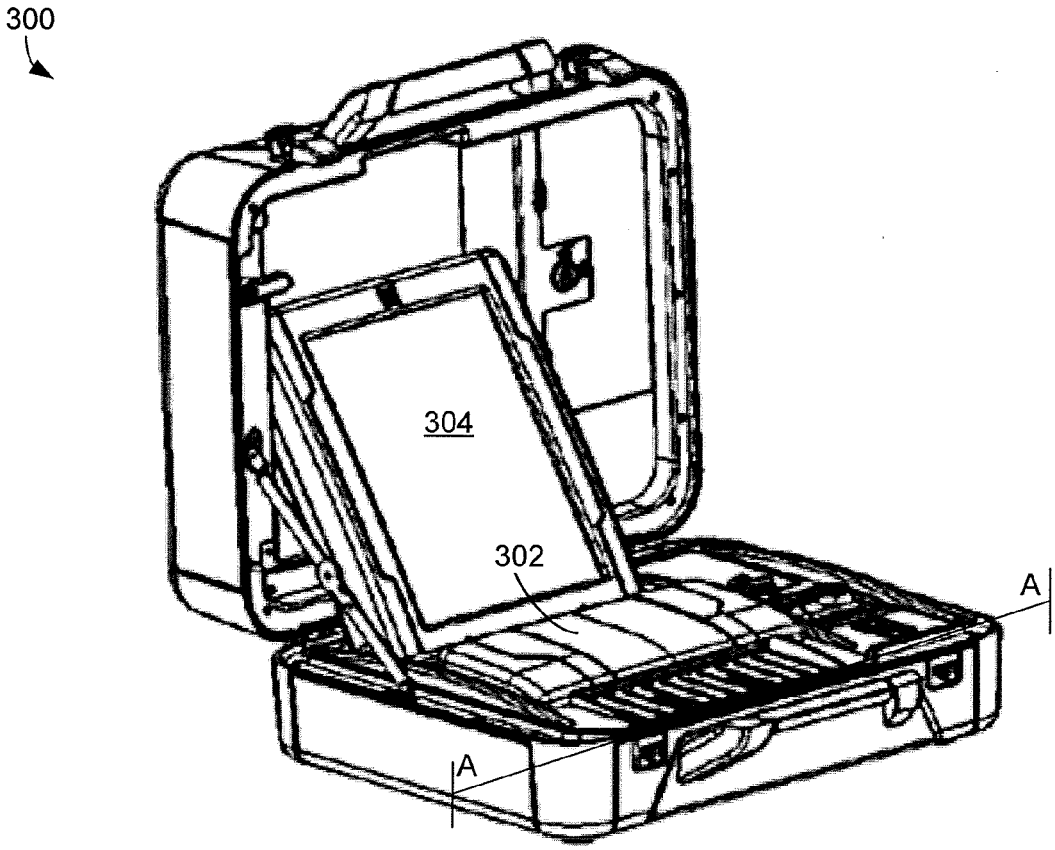
FIG. 3 illustrates an electronic voting machine with a ballot processing unit in accordance with certain embodiments the present disclosure.

FIG. 3 illustrates electronic voting machine 300 with a ballot processing unit 302 in accordance with certain embodiments the present disclosure. The embodiment shown in FIG. 3 is for illustration only. Other embodiments could be used without departing from the scope of this disclosure.

Electronic voting machine 300 is used to process ballots in an election. Electronic voting machine 300 comprises display 304 and ballot processing unit 302. Ballot processing unit 302 comprises a scan unit to scan ballots that are to be cast in an election. Display 304 displays information related to electronic voting machine 300. If a ballot is attempted to be cast with too many or too few selections, this issue is indicated to the voter attempting to cast the ballot via display 304.

Figure 4:
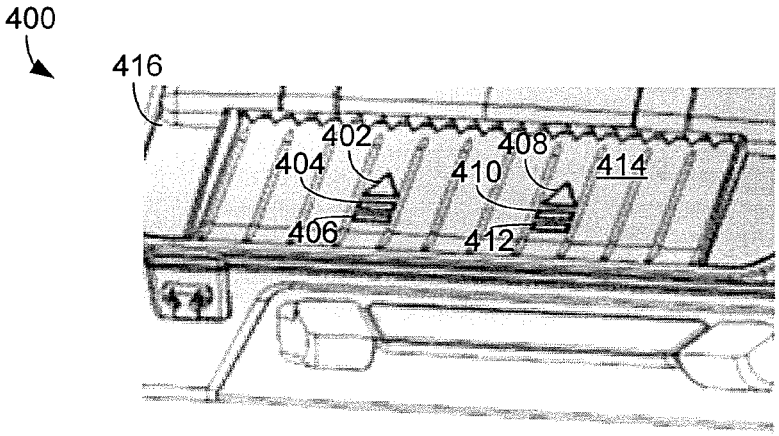
FIG. 4 illustrates one or more lights of an electronic voting machine 400 in accordance with certain embodiments of the present disclosure.

FIG. 4 illustrates one or more lights 402-412 of electronic voting machine 400 in accordance with certain embodiments of the present disclosure. The embodiment shown in FIG. 4 is for illustration only. Other embodiments could be used without departing from the scope of this disclosure.

Electronic voting machine 400 is an embodiment of electronic voting machine 300 and is displayed from View A shown in FIG. 3. Electronic voting machine 400 comprises scan unit 416.

Scan unit 416 receives a paper ballot and scans the paper ballot so that the paper ballot may be checked for any issues, including too few selections may, too many selections made, whether a ballot is defective or damaged, and the like. Scan unit 416 comprises receiving tray 414.

Receiving tray 414 receives a ballot that is to be cast by a voter. Receiving tray hundred and 14 includes one or more lights 402-412.

Lights 402-412 are controlled by electronic voting machine 400 to aid the voting process. Lights 402-412 comprise rectangular lights 404, 406, 410, and 412 and triangular lights 402 and 408. Lights 402-406 and lights 408-412 are flashed or strobed sequentially in a direction towards an input of scan unit 416 when electronic voting machine 400 is ready to receive a ballot. Lights 404-406 and 410-412 are lit up steadily when electronic voting machine 400 is not ready to receive a ballot.

The sequential strobing comprises lighting light 406 green without lighting lights 402-404, then lighting light 404 green without lighting lights 402 and 406, then lighting light 402 green without lighting lights 404-406, and repeating. A similar pattern is used with lights 408-412, which can be synchronized respectively with lights 402-406. Flashing with the color green towards the input of the scan unit 416 indicates that electronic voting machine 400 is ready to receive a ballot, indicates where the ballot should be placed, and indicates the direction of how electronic voting machine 400 will receive the ballot.

The steady lighting of lights 404-106 and 410-412 comprises lighting lights 404-406 and 410-412 red without lighting lights 402 and 408. Providing a steady red light indicates that electronic voting machine 400 is not ready to receive the ballot.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A method, comprising:

sequentially lighting a series of lights of a ballot processing device in a first, repeating sequence along a direction for inserting a ballot into the ballot processing device and in a first color when the ballot processing device is ready to receive a ballot; and steadily lighting at least one of the lights of the ballot processing device in a second color when the ballot processing device is not ready to receive a ballot.

2. The method of claim 1, wherein the series of lights comprise a first rectangular light, a second rectangular light, and a triangular light.

3. The method of 2, further comprising sequentially strobing the first rectangular light, the second rectangular light, and the triangular light in a direction towards an input of a scan unit into which ballots are inserted into the ballot processing device when the ballot processing device is ready to receive a ballot.

4. The method of claim 2, comprising steadily lighting the first rectangular light and the second rectangular light without lighting the triangular light when the ballot processing device is not ready to receive a ballot.

5. The method of claim 1, wherein the ballot processing device is ready to receive a ballot when the ballot processing device is in a polls open state.

6. The method of claim 1, wherein the ballot processing device is not ready to receive a ballot when one or more of:

the ballot processing device is in a polls closed state, the ballot processing device is in a start up state, the ballot processing device is in an error state, and the ballot processing device detects an issue with a ballot received by the ballot processing device.

7. The method of claim 1, wherein the ballot processing device comprises a scan unit configured to scan ballots entered into the scan unit and the series of lights are housed by a receiving tray of the scan unit.

8. An electronic voting machine, comprising:

a ballot processing device; and a series of lights housed by the ballot processing device, wherein the ballot processing device is configured to sequentially light the series of lights in a first, repeating sequence along a direction for inserting a ballot into the ballot processing device and in a first color when the ballot processing device is ready to receive a ballot, and to steadily light at least one of the lights in a second color when the ballot processing device is not ready to receive a ballot.

9. The electronic voting machine of claim 8, wherein the at least one of the lights comprise a first rectangular light, a second rectangular light, and a triangular light.

10. The electronic voting machine of 9, wherein the ballot processing device is configured to sequentially strobe the first rectangular light, the second rectangular light, and the triangular light in a direction towards an input of a scan unit into which ballots are inserted into the ballot processing device when the ballot processing device is ready to receive a ballot.

11. The electronic voting machine of claim 9, wherein the ballot processing device is configured to steadily light the first rectangular light and the second rectangular light without lighting the triangular light when the ballot processing device is not ready to receive a ballot.

12. The electronic voting machine of claim 8, wherein the ballot processing device is ready to receive a ballot when the ballot processing device is in a polls open state.

13. The electronic voting machine of claim 8, wherein the ballot processing device is not ready to receive a ballot when one or more of:

the ballot processing device is in a polls closed state, the ballot processing device is in a start up state, the ballot processing device is in an error state, and the ballot processing device detects an issue with a ballot received by the ballot processing device.

14. The electronic voting machine of claim 8, wherein the ballot processing device comprises a scan unit configured to scan ballots entered into the scan unit and the series of lights are housed by a receiving tray of the scan unit.

15. A computer readable medium comprising a program containing instructions that, when executed by one or more processors, make the one or more processors:

cause a series of lights of a ballot processing device to sequentially light in a first, repeating sequence along a direction for inserting a ballot into the ballot processing device and in a first color when the ballot processing device is ready to receive a ballot; and cause at least one of the lights of the ballot processing device to steadily light in a second color when the ballot processing device is not ready to receive a ballot.

16. The computer readable medium of claim 15, wherein the ballot processing device comprises a scan unit configured to scan ballots entered into the scan unit and the series of lights are housed by a receiving tray of the scan unit.

17. The computer readable medium of claim 16, wherein the series of lights comprise a first rectangular light, a second rectangular light, and a triangular light.

18. The computer readable medium of claim 17, wherein the instructions, when executed by the one or more processors, make the one or more processors produce sequential strobing of the first rectangular light, the second rectangular light, and the triangular light in a direction towards an input of the scan unit.

19. The computer readable medium of claim 18, wherein the instructions, when executed by the one or more processors, make the one or more processors produce steady lighting of the first rectangular light and the second rectangular light without lighting the triangular light.

20. The computer readable medium of claim 15, wherein the ballot processing device is ready to receive a ballot when the ballot processing device is in a polls open state, and wherein a ballot processing device is not ready to receive the ballot when one or more of:

the ballot processing device is in a polls closed state, the ballot processing device is in a start up state, the ballot processing device is in an error state, and the ballot processing device detects an issue with a ballot received by the ballot processing device.

* * * * *